United States Patent [19]

Guild

[11] Patent Number: 4,829,692

[45] Date of Patent: May 16, 1989

[54] WEAPON SAFETY ALARM

[76] Inventor: Ralph K. Guild, 421 East 37th Street, Hamilton, Ontario, Canada, L8V 4B7

[21] Appl. No.: 151,877

[22] Filed: Feb. 3, 1988

[51] Int. Cl.[4] ..... F41C 17/02

[52] U.S. Cl. ..... 42/1.01; 340/540

[58] Field of Search ..... 42/1.01; 340/540, 529, 340/530, 309.15

[56] References Cited

U.S. PATENT DOCUMENTS

| | | | |
|---|---|---|---|
| 666,405 | 1/1901 | Baggett | 42/1.01 |
| 2,134,406 | 10/1938 | Jacobs | 42/1.01 |
| 3,044,204 | 7/1962 | Zimmerman | 42/1.01 |
| 3,842,526 | 10/1974 | Dixon | 42/1.01 |
| 4,476,644 | 10/1984 | Laing | 42/1.01 |
| 4,719,713 | 1/1988 | Haggle | 42/1.01 |
| 4,739,569 | 4/1988 | Battle | 42/1.01 |

*Primary Examiner*—Deborah L. Kyle
*Assistant Examiner*—Michael J. Carone
*Attorney, Agent, or Firm*—McConnell and Fox

[57] ABSTRACT

A safety alarm system for small arms arranged to be incorporated within the structure of the gun. A battery energizes an electronic circuit through a switch activated by the safety mechanism of the gun. A predetermined time after energization the electronic circuit activates a visual or audible alarm to warn the handler that the weapon safety mechanism has been deactivated.

3 Claims, 2 Drawing Sheets

WEAPON SAFETY ALARM

FIELD OF THE INVENTION

This invention relates to safety alarm systems and in particular to a safety alarm to be associated with small arms such as rifles and shotguns.

DESCRIPTION OF THE PRIOR ART

It is conventional in small arms to include a safety mechanism to inhibit operation of the trigger mechanism and ensure that the weapon may not be inadvertently discharged. Generally, an indication of whether the safety is on or off is a mere visual indication of the position of the safety mechanism. It is evident, however, that in many circumstances the visual indication may not be sufficient and indeed, under some conditions, may not even be visible. It is therefore the purpose of this invention to provide an indication as to whether the safety mechanism has been deployed, in such a way that the condition of the safety mechanism will be drawn to the attention of the user and avoid inadvertent discharge of the firearm.

SUMMARY OF THE INVENTION

In accordance with the present invention, a switch is associated with the safety mechanism of the weapon and is actuated by the safety mechanism. A predetermined time after the switch is actuated, an electronic circuit causes an audible and/or visual alarm to be actuated thus warning the user that the safety mechanism has not been applied.

A clearer understanding of the invention may be had from a consideration of the following description and drawing in which.

DESCRIPTION OF THE PREFERRED EMBODIMENT

Figure 1:
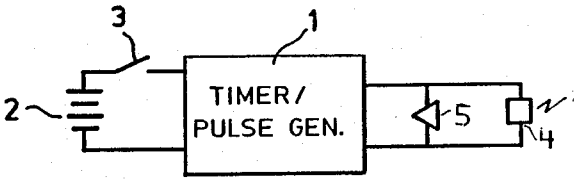
FIG. 1 is a block diagram of the system.

Considering first FIG. 1, there is shown an alarm circuit 1 which is supplied with energy from a battery 2 and is controlled by a switch 3. The output from the electronic circuit is applied to indicators 4 and 5, 4 being a LED and 5 an acoustic transducer.

Figure 2:
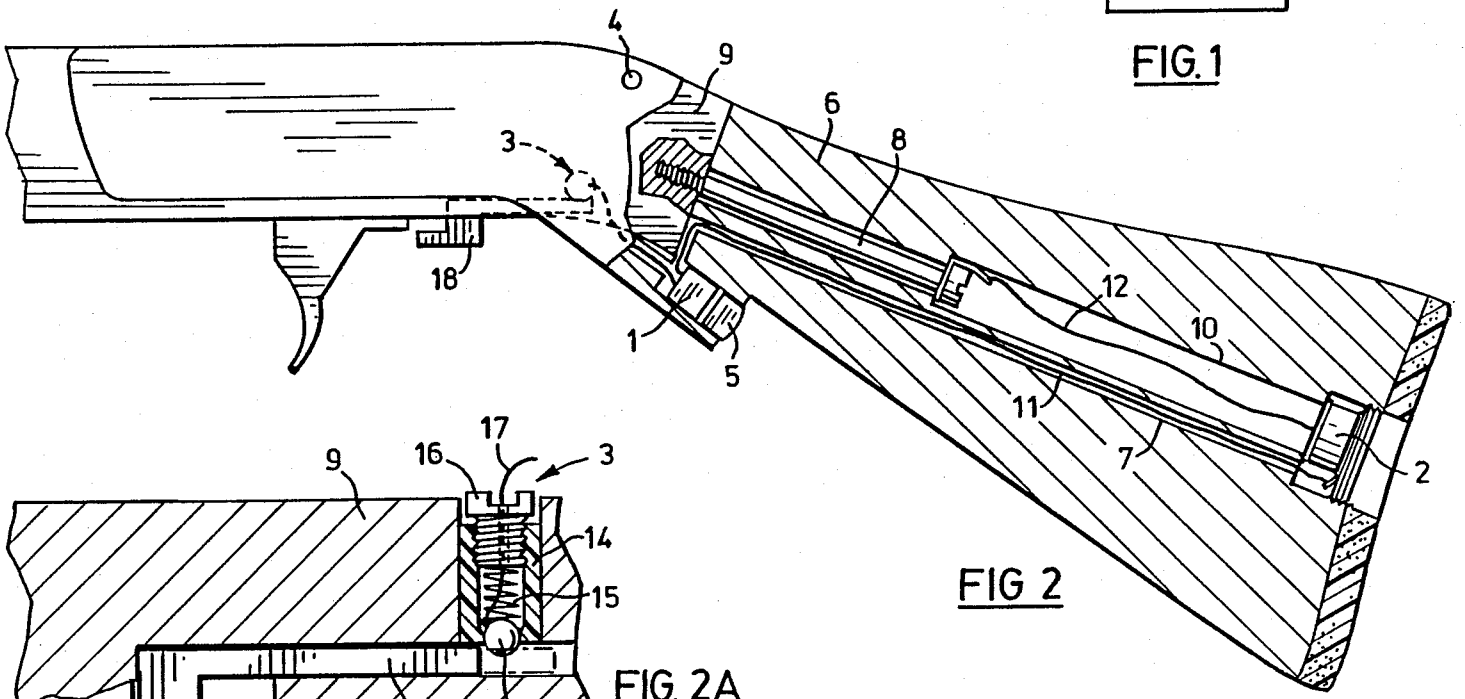
FIG. 2 is an illustration, partly in section, of a typical installation of the alarm system.
Figure 2A:
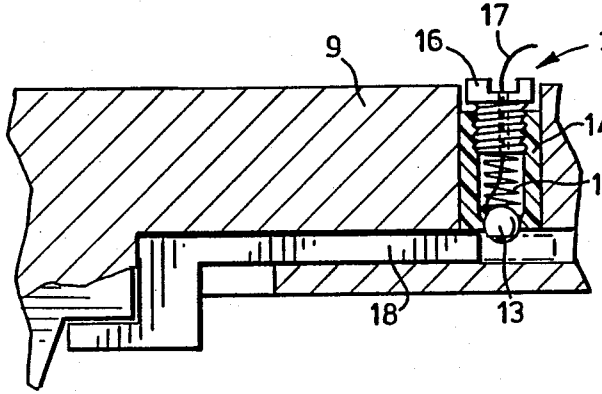
FIG. 2A is a detail of a component of the alarm system.

FIG. 2 illustrates the location of the various elements of the system of FIG. 1 within a typical weapon. As will be seen, the stock of the weapon, designated 6, has a bore 10 for access to the bolt 8 which retains the stock 6 on gunbody 9 and an opening at the butt providing a chamber to accept battery 2. A small bore 7 is provided through the butt to conduct a wire 11 from one terminal of battery 2 to the electronic circuit 1 which is located within the normal mechanism compartment of the weapon. The other terminal of battery 2 is connected through wire 12 to bolt 8 which retains the stock 6 on gunbody 9. The switch 3, shown in more detail in FIG. 2A, is also located within the body 9 of the gun in proximity to the safety mechanism so that the switch is operated when the safety mechanism is operated. As will be seen from FIG. 2A, the switch comprises a metallic ball 13 retained in a plastic bolt 14 and urged outward by spring 15. A bolt 16 has a central bore through which passes insulated wire 17 which is connected to ball 13. When the slide 18 of the safety mechanism moves to the right, it completes a circuit between the body 9 and the ball 13, thus connecting the wire 17 to the body 9 and thus to a terminal of the battery. The wire 17 in turn is connected to the electronic circuit 1. A further bore in the stock provides an aperture to receive the acoustic transducer 5. The LED 4 may be located elsewhere in the weapon in a place easily viewed by the user, for example, at a location on the side of the stock nearest the operating mechanism of the weapon.

OPERATION OF THE SYSTEM

With the system installed in a weapon as shown in FIG. 2, the circuit 1 is not energized unless the switch 3 is closed. Switch 3 is closed only when the safety is released. Battery voltage i applied to the circuit through the switch. A predetermined time after application of battery voltage the electronic circuit 1 produces an output, activating the transducer and the LED causing both a visual and audible alarm warning the user that the safety on the weapon has been released. If the safety is now reapplied or is reapplied before the electronic circuit causes the alarm to sound, the electronic circuit is reset and will not reactivate the transducer or LED until the safety is once more released, switch 3 is closed and a predetermined time interval elapses.

As has been previously indicated, switch 3 as shown in FIG. 2A, provides the necessary connection between wire 12 from the battery through bolt 8, body 9, slide 18, ball 13 and wire 17 to the electronic circuit.

Figure 3:
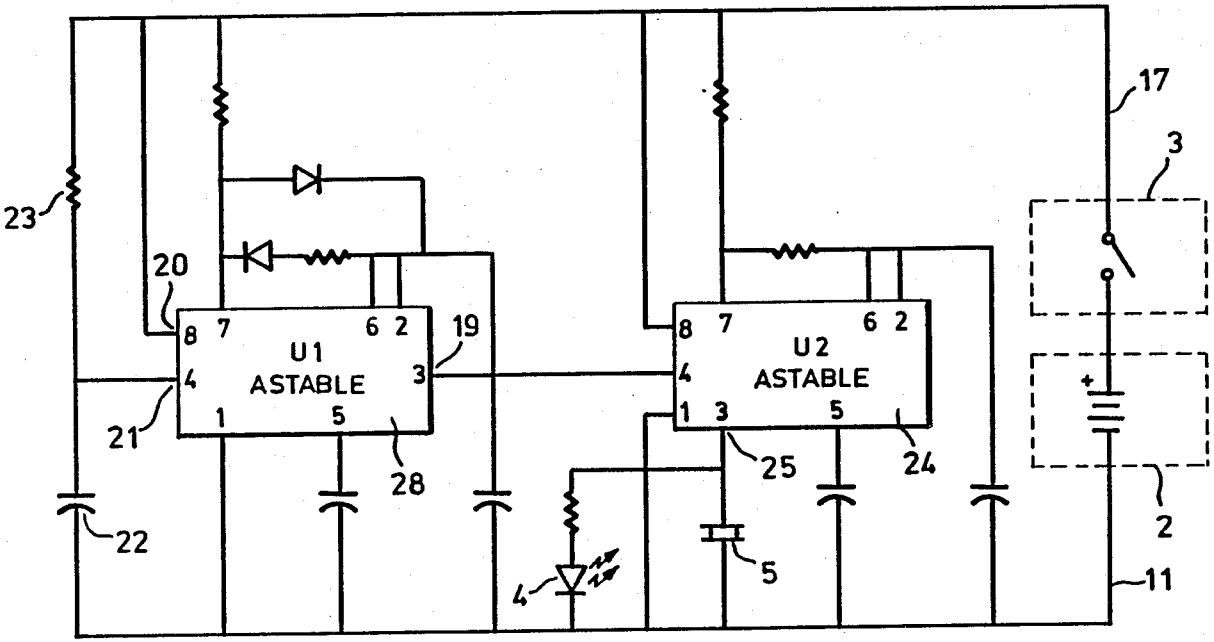
FIG. 3 is an electronic circuit diagram of an alarm circuit suitable for use in the system of FIG. 1.

A suitable electronic circuit for activating the alarm in response to the switch 3 is shown in greater detail in FIG. 3. As will be seen in FIG. 3, when switch 3 is closed the battery voltage from battery is applied through wire 17 to the electronic circuit. Astable 28 initially has a zero output on its terminal 19 because the voltage applied to its input terminal 20 is greater than the voltage applied to its input terminal 21. However, as capacitor 22 charges through resistor 23, the potential on terminal 21 approaches the potential on terminal 20 and at a predetermined time, determined by the resistance of resistor 23 and the capacity of capacitor 22, astable 28 assumes its unstable condition and produces a 1 hertz output at terminal 19. This output is applied to astable 24 which is arranged to produce an output at a 5 kilohertz frequency at terminal 25. The 1 hertz signal from terminal 19 results in a series of bursts at a 5 kilohertz frequency and a 1 hertz repetition rate at terminal 25. This output from terminal 25 is applied to transducer 5 and to LED 4, producing an audible output from transducer 5 in the form of a series of 5 kilohertz bursts of sound and an output from LED 4 as a series of flashes of light.

When switch 3 is open, capacitor 22 is discharged, the output from circuit 28 becomes a zero and the operation of both the transducer and the LED is terminated. If the switch 3 is once more closed, the operation repeats with the timing interval once more determined by the rate of charge of capacitor 22 through resistor 23.

While a specific electronic circuit has been shown, it will be understood that numerous variations could be made to perform similar functions. It is only necessary that the transducer and LED be activated at a predetermined time after the closure of switch 3 and produce a suitable audible and/or visual output.

The actual construction of switch 3 and its location will depend upon the particular weapon. It is only necessary that the switch be of suitable size as to be placed within the mechanism chamber and be of suitable nature as to be actuated by the actuation of the safety mechanism.

It will also be understood that while the battery, transducer, electronic circuit and switch have been shown in particular locations, these locations will vary depending upon the nature of the weapon to which the system is applied. It is, however, desirable that all components be placed in locations that do not detract from the normal shape and function of the weapon and that the transducer and LED are so located as to suitably alert the user and others to the fact that the safety has been released.

I claim:

1. A safety alarm system for a weapon comprising:

a gunbody and a stock mounted on said gunbody, an aperture in the shoulder end of said stock enclosing an electric battery, a first conductor from a first terminal of said battery to said gunbody, a resilient electrical contact mounted in, but insulated from, said gunbody adjacent a metallic safety mechanism mounted in and electrically connected to, said gunbody, said electrical contact being contacted by said safety mechanism when said safety mechanism is in its operative position, a second conductor connected from said electrical contact to an electronic circuit mounted in said stock, a third conductor connected from said electronic circuit to the second terminal of said battery, said electronic circuit comprising a capacitive integrating circuit input which, when energized by a potential between said second and third conductors, produces a gradually increasing voltage output, a first astable device connected to the output of said integrating circuit, said first astable device producing a subaudible frequency pulsed electrical output when the output of said integrating circuit reaches a selected value and a second astable device connected to the output of said first astable device which produces an audible frequency pulsed electrical output in response to the output of said first astable device, at least one indicator mounted in said stock connected to the output of said second astable device for producing an indication of the condition of said safety mechanism in response to the said output of said second astable device.

2. A safety alarm system as claimed in claim 1 wherein said indicator produces an audible output.

3. A safety alarm system as claimed in claim 1 wherein said indicator produces a visible output.

* * * * *